US006470654B1

(12) United States Patent
Lachenmeier et al.

(10) Patent No.: US 6,470,654 B1
(45) Date of Patent: Oct. 29, 2002

(54) METHOD AND APPARATUS FOR PACKAGING OBJECTS

(75) Inventors: Kurt Lachenmeier, Sonderborg (DK); Flemming Thomsen, Garsten (DK)

(73) Assignee: KL-Lachenmeier A/S, Sonderborg (DK)

( * ) Notice: Subject to any disclaimer, the term of this patent is extended or adjusted under 35 U.S.C. 154(b) by 0 days.

(21) Appl. No.: 09/549,225

(22) Filed: Apr. 13, 2000

(30) Foreign Application Priority Data

Apr. 16, 1999 (EP) ..... 99107666

(51) Int. Cl.[7] ..... B65B 9/10
(52) U.S. Cl. ..... 53/567; 53/459; 53/461
(58) Field of Search ..... 53/384.1, 461, 53/580, 209, 389.1, 389.3, 459, 567

(56) References Cited

U.S. PATENT DOCUMENTS 4,651,508 A * 3/1987 Hannen ..... 53/557
4,724,658 A * 2/1988 Birkenfeld et al. ..... 53/557
5,247,783 A * 9/1993 Hannen ..... 53/567
5,398,487 A * 3/1995 Inman et al. ..... 53/567
6,298,636 B1 * 10/2001 Lachenmeier et al.

FOREIGN PATENT DOCUMENTS

| | | | |
|---|---|---|---|
| DE | 0633186 A1 * 6/1991 | ..... | B65B/9/14 |
| DE | 4019041 C1 * 10/1991 | ..... | B65B/9/14 |
| DE | 4019127 C2 * 11/1994 | ..... | B65B/9/14 |
| EP | 0 633 186 A1 1/1995 | ..... | B65B/9/14 |

* cited by examiner

*Primary Examiner*—Rinaldi I. Rada
*Assistant Examiner*—Gloria R Weeks
(74) *Attorney, Agent, or Firm*—Fish & Richardson P.C.

(57) ABSTRACT

In a method for packaging objects a means for generating a foil hood 6 and several gripping means 8 for gripping and tenting said foil hood 6 are provided for. Said foil hood 6 is pulled onto several bow-like frame sections 8*a* and bow supports 8*b* and is tented such that said tented opening said foil hood 6 is larger than the object to be packed, wherein said foil hood 6 is pulled over said object with a certain extension transverse to the plane of the tented opening of said foil hood. Subsequently, said foil hood 6 is pulled over said gap 15. Thereby, an increased resistance occurs during pulling-off. The vertical stretch is improved. Simultaneously, said foil is particularly safely held when creating the understretch during the pulling-over end phase.

29 Claims, 9 Drawing Sheets

METHOD AND APPARATUS FOR PACKAGING OBJECTS

BACKGROUND OF THE INVENTION

The invention pertains to a method for packaging objects as defined in the preamble of claim 1 and to an apparatus for packaging objects as defined in the preamble of claim 6.

Methods and apparatuses of the generic kind are particularly used for packaging stacks of goods arranged on pallets, for securing the good to be packed against slipping on the pallet caused by the forces occurring during transport and to protect the stack of goods against humidity and other environmental influences. The foil hood for this purpose is stretched in transverse and longitudinal directions when being pulled over. I.e. it is elastically stretched in transverse direction prior to being pulled over and is elastically stretched in longitudinal direction during being pulled over. After having been pulled over, the foil hood on all sides resiliently bears on the stack of goods and the enclosed pallet. It reaches below the pallet. The foil hood compresses the stack of goods frequently consisting of individual bags or boxes and in its entity presses it against the pallet.

The plastic foils used for such packagins are elastically extensible to a high extent. However, they at the same time have high internal friction, i.e. the elastically extended foil after relief does not return into its relieved position in a "bouncing movement" completely. Return into the relieved position at least partly rather is effected in a continuous movement requiring some period of time.

From EP-A-0 633 186 a method and an apparatus for enveloping unit loads, in which a stretch foil is pulled over a stack of goods. For this purpose, at first a foil hose is welded at a desired length to form a foil hood and is cut above the welding seam. The thus created foil hood is reefed by means of reef rolls onto four gripping means tenting a rectangle and are transversely stretched into a shape being somewhat larger than the cross-section of the stack of goods to be packaged. Subsequently, the foil hood is pulled over the stack of goods by a downward movement of the gripping means and therein is stretched in longitudinal direction in that the foil is pulled away from the gripping means with the occurrence of substantial sliding friction. For increasing the friction of the foil during removal, i.e. for optimizing the vertical stretching, the foils is pressed against the gripping means by means of the reef rolls. The foils pulled down from the gripping means due to the high internal friction does not immediately solidly bear on the side wall of the charge. Rather is such solid contact fixing the foil on the charge in frictional connection, only effected after some time, i.e. with some distance from the gripping means which in the meantime moved further downwardly. In the lower region of the stack of goods, i.e. when reaching the lower edge of the pallet, therefore, the foil hood is not simply released, because in case of letting it go, the foil which did not yet contact the charge in frictional connection in the lower area would contract in horizontal as well as in vertical directions. The foil end would be pulled up above the bottom edge of the pallet into the lateral area of the pallet even before it could contract in horizontal direction so much that it reliably reaches below the pallet. In order to avoid this, a so-called under-stretch is actively created in the lower area of the stack of goods. This is effected in that the gripping means holding the foil end are moved in inward direction as compared to the contour for pulling over (i.e. the contour with the foil hood has during being pulled over), i.e. under the pallet in particular. By the inside movement of the gripping means the foil end still tented on the gripping means is discharged, i.e. the friction between the gripping means and the foil end still tented on them decreases. This increases the danger that the foil end slips from the gripping means already before completion of the understretch. In order to avoid this, the foil hood is pressed against the gripping means by means of the reef rolls and thus is safely held on the gripping means also in case of decreasing tension between the foil end and the latter ones.

It is true that in this method the vertical stretch is improved by pressing the foil hood by means of the reef rolls. However, an improvement only is possible to a certain degree, as an excessive pressure of the reef rolls acting on only a narrow area at the corners of the gripping means can cause damage of the foil during removal. Under certain circumstances holes or at least undesired plastically deformed areas can be created in the foil hood by excessive pressure of the reef rolls. In addition, pressing the foils to the grippers for safely holding the foil on the grippers during creation of the understretch includes disadvantages. The reef rolls cannot act on the outermost (seen in direction of pulling off of the foil) end of the frame sections which come to lie directly below the pallet bottom edge, at least not without additional constructional expense having to be accepted. For this reason, below the pallet bottom edge an unnecessarily long foil section which is not be required for the proper understretch per se has to be provided for only for making sure that the foil end reliably protrudes until in the area of the reef rolls.

From the DE90 01 319 U1 another apparatus for packaging goods is known in which movable clamping jaws are used for pressing the foil hood in a lower area against the stack of goods. Also this way of action prevents the foil from slipping upwardly, until the understretch is completed, however, it can easily cause undesired damaging of the foil hood and/or the good to be packed, respectively, and in addition also involves undesired additional constructional expense.

SUMMARY OF THE INVENTION

It is, therefore, the main of the present invention to avoid the above-cited disadvantages and to create a method and an apparatus for packaging objects with a stretch foil hood, in which the vertical stretch of the foil is improved with lowest constructional expense possible and an understretch of the foil hood can be reliably created with a very small excessive length of the foil with respect to the pallet bottom edge.

This object is in advantageous manner solved in accordance with the method in accordance with the present invention with the characterizing features of claim 1 and in accordance with the corresponding apparatus with the characterizing features of claim 6.

By the fact that the foil is guided over at least one recess of the slide surface, i.e. at least one section in the slide surface which is recessed as compared to the slide surfaces directly prior and subsequent thereto in direction of sliding, the resistance which the foil puts up against its being pulled off is optimized, because the foil contracts under its pretension in the region presently bridging the recess. Thereby, it ingresses into the recess. When leaving the recess, the foil again is deflected and again is stretched due to the positive lock with the area deflecting it. Herein, an intense frictional connection occurs. It is not absolutely necessary that the bow-shaped frame sections protrude over the adjacent contour of the frame support particularly.

In accordance with a particularly preferable embodiment of the method and the apparatus it is provided that the recess across which the foil is guided is built as gap between the bow-shaped frame section and the bow support. As the bow-shaped frame section and the bow support generally anyway represent two individual components, a gap can be realized in particularly simple manner by enlarging the separating gap therebetween.

In accordance with a particularly preferable further development of the method and the apparatus it is provided that the gap is or can be changed in its depth T and/or its length L prior to or during pulling off the foil. By the general adjustability, the gap can be adapted to the parameters important for each individual case, like foil material, foil thickness, pulling-over speed, pretension of foil, profile of the stack of goods to be packed etc. As the gap can be adjusted during the pulling-over movement, it becomes possible to account for e.g. friction conditions changing in the course of pulling-over, a charge contour changing in direction of pulling-over and also for other parameters changing in course of pulling-over. As the depth T of the gap (i.e. the distance from the deepest point of the gap to the highest point of the sliding surface directly following the foil in direction of pulling off) and the length L of the gap can be adjusted independently from one another, a particularly fine adaption to the respective conditions is possible.

In accordance with a particularly preferred embodiment of the method in accordance with the present invention the foil is guided such that the lower rim of the foil hood during the final phase of pulling over snaps into the gap and contracts such that the foil end at least temporarily is held during the movement of the gripping means to the inside with respect to the pulling-over contour for creating an understretch. Wrapping of the slide surface still being into contact with the foil is intensified by such guiding of the foil, friction is increased.

In correspondence with another embodiment of the method in accordance with the present invention the foil is guided over the gap such that it only partly is in contact with the surfaces bordering the gap. Thereby, folds in the foil can extended, before the foil runs over the bow-shaped frame sections.

In accordance with another embodiment of the apparatus in accordance with the present invention the at least one recess of the slide surface is located as close as possible to the end of the gripping means, at which the foil leaves the gripping means. Due thereto, an only very short foil section is sufficient for holding the foil on the gripping means, while those are moved in inward direction with respect to the pulling-over contour for creating an understretch. Foil is saved.

In accordance with another embodiment of the apparatus in accordance with the present invention the slide surface in leaving direction of the foil merges into the recess almost in a leap. Thereby, the snapping in of the foil end into the recess is favored which is in particular important for the holding of the foil during creation of the understretch, in that the foil end is relieved almost suddenly when reaching the recess.

Preferably, the apparatus in accordance with the present invention is realized such that the gap at each gripper means extends over the entire outer circumference thereof. Thus, during pulling off of the foil in the pulling-over phase an increased resistance occurs on the entire circumference of the bow-like frame section, this improving the vertical stretch. Moreover, this design can improve holding of the foil in the phase of creation of the understretch.

BRIEF DESCRIPTION OF DRAWINGS

In the following the invention will be described in more detail with reference to a preferred embodiment with reference to the attached drawing. In the drawing.

DETAILED DESCRIPTION OF PREFERRED EMBODIMENT

Figure 1:
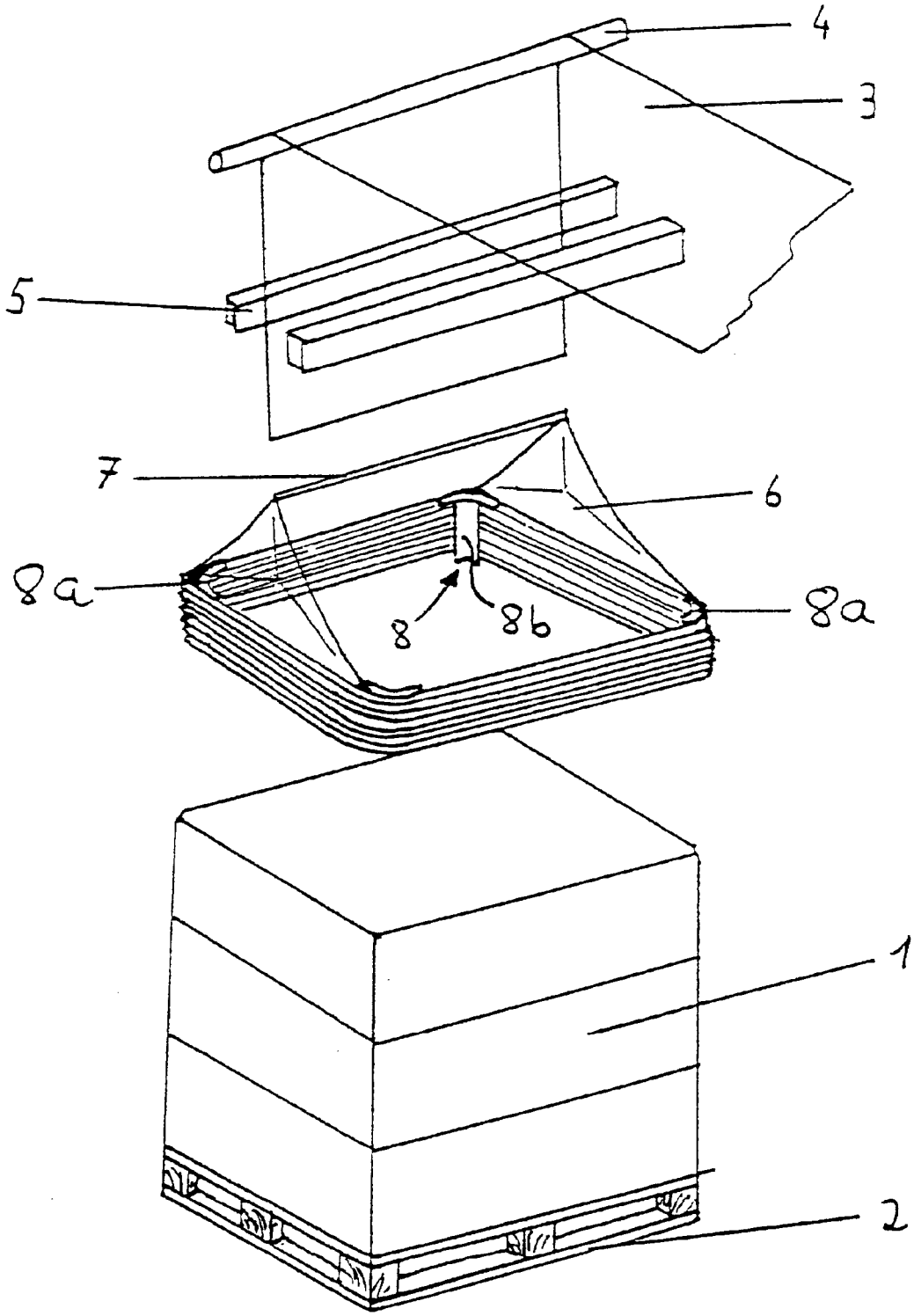
FIG. 1 shows a perspective view of the essential parts of an apparatus for packaging objects in accordance with an embodiment of the present invention.

1 Stack of Goods on Pallet
2 Pallet
3 Foil Hose (pulled off from supply in folded manner)
4 Deflection Rod or Deflection Roll
5 Welding and Cutting Device
6 Foil Hood
**6*a*** Resting Reefed Foil Hood
**6*b*** Outermost Corner of Foil Hood
**6*c*** Outer Edge of Foil Hood
**6*d*** Opening of Foil End; i.e. Hood Opening
**6*e*** Fold Wrapping in the Foil
7 Head Welding Seam of Foil Hood
8 Gripping Means
**8*a*** Bow-Like Frame Section
**8*b*** Bow Support
**8*c*** Slide Surface of Bow-Like Frame Section
**8*d*** Slide Surface of Bow Support
9 Counterroll for Reef Roll
10 Reef Roll
11 Arm
12 Guide
13 Vertical Guide of Holding Section
14 Vertical Guide of Holding Section
15 Constriction or Gap The apparatus shown in FIG. 1 for packaging objects 1 on a pallet 2 comprises a supply roll (not shown) for a folded foil hose 3 which is unwound from said supply roll and is supplied to a central packaging unit. Said packaging unit comprises a frame into which the objects to be packed are transferred and a packaging apparatus guided on said frame. For better illustration only the components having relevance for the invention are shown of this packaging apparatus.

As can be seen from FIG. 1, said foil hose is guided over a deflection rod 4 perpendicularly in downward direction to a welding and cutting device 5. Below said welding and cutting device 5 said foil hose 3 is opened and seized by four movable gripping means 8. Said gripping means 8 consist of the bow-shaped frame sections 8*a* and the bow supports 8*b*. Said bow-shaped frame sections 8*a* and said bow supports are of L or C shape and thus define the corners of said foil hood.

Subsequently to seizure of said foil hose 3 a given length of said foil hose 3 is reefed onto said gripping means. This is effected in that on each gripping means 8 respectively a reef roll 10 pulls said foil hood 3 onto said gripping means, this causing said foil hose to fold up on the leaving side of said reef roll to form a folded supply 6*a*. (Reefing of the foil by means of the reef rolls is now shown in the drawing). Said foil hose 3 then is welded together in a desired length and is cut off such that a foil hood 6 is created which is tented to form a rectangle by said four gripping means 8. Said thus tented foil hood 6 in a next step is extended in horizontal direction such that the lower opening of said foil hood 6 is a little bit larger than the cross-section of the stack 1 of goods to be packed. In this condition said foil assumes its "pull over contour". Subsequently, said foil hood 6 is moved in downward direction and pulled onto said stack 1 of goods. The end welded together, of said foil hood bears onto the upper surface of said stack 1 of goods. Said foil braked by said gripping means 8 then is pulled off. Therein, it is stretched in vertical direction.

Figure 2:
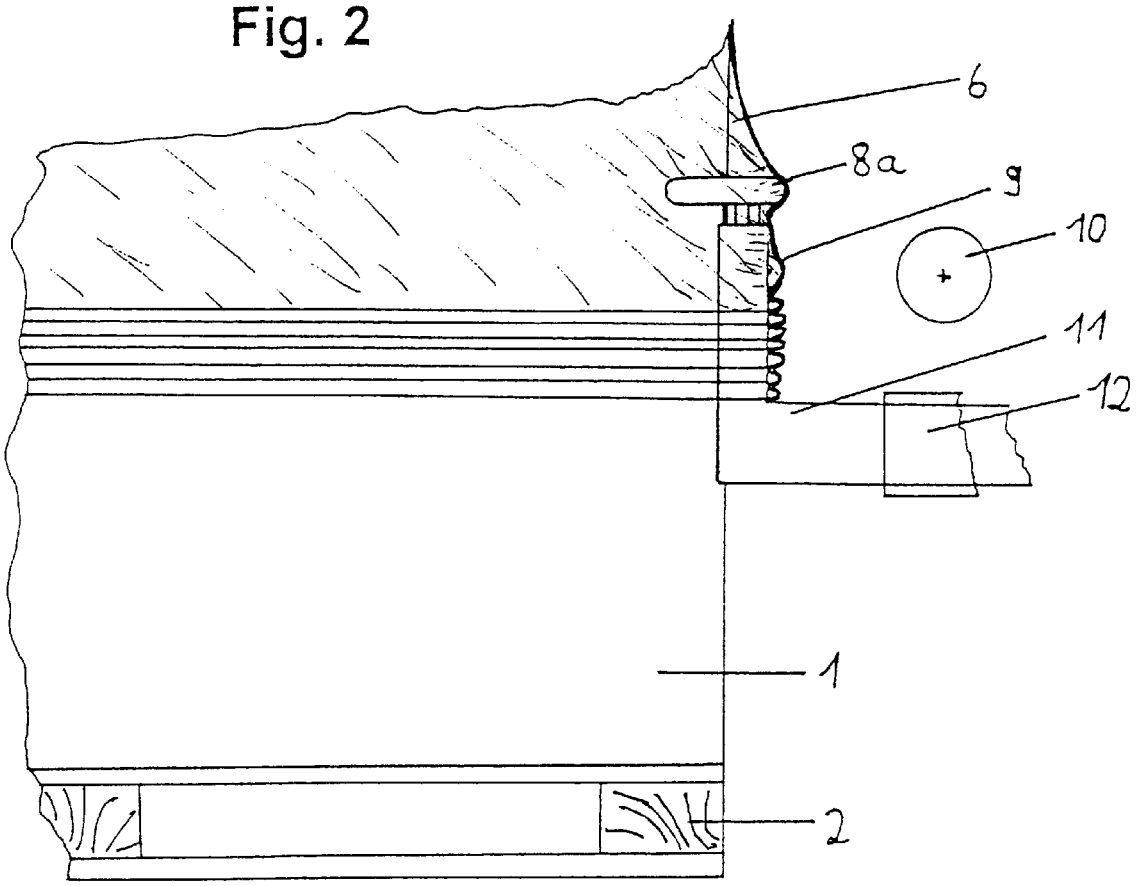
FIG. 2 shows a gripping means during pulling of the foil hood over the object.
Figure 3:
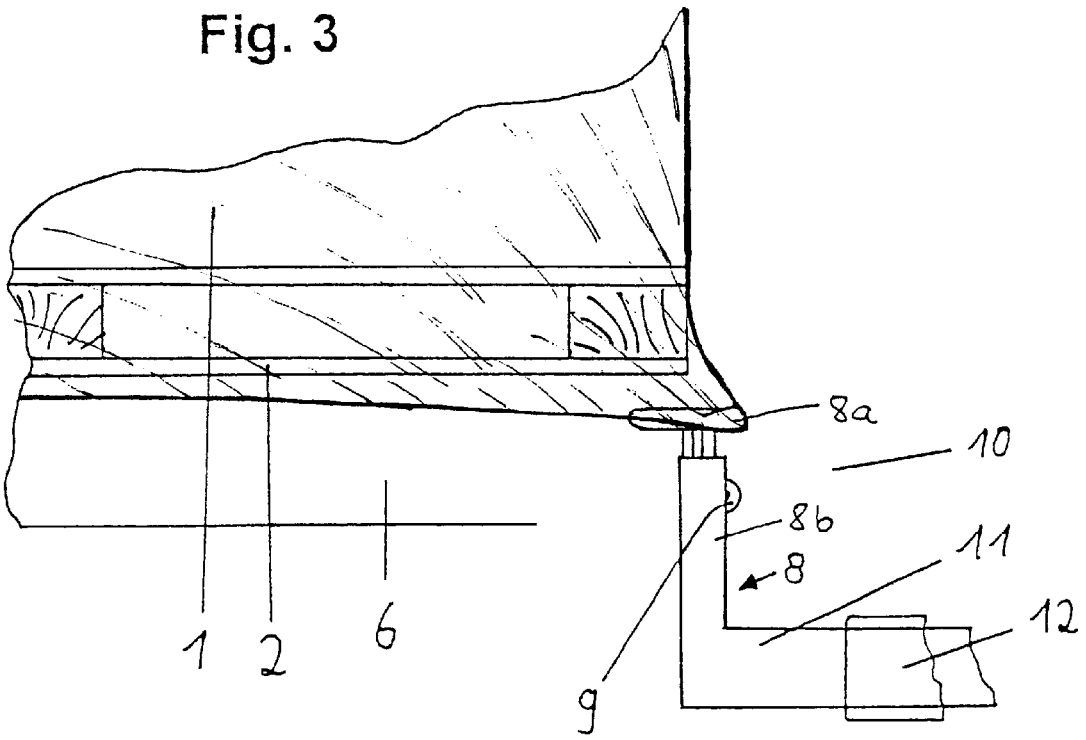
FIG. 3 shows a gripping means after pulling-over of the foil hood, prior to creation of the undershrink.
Figure 5:
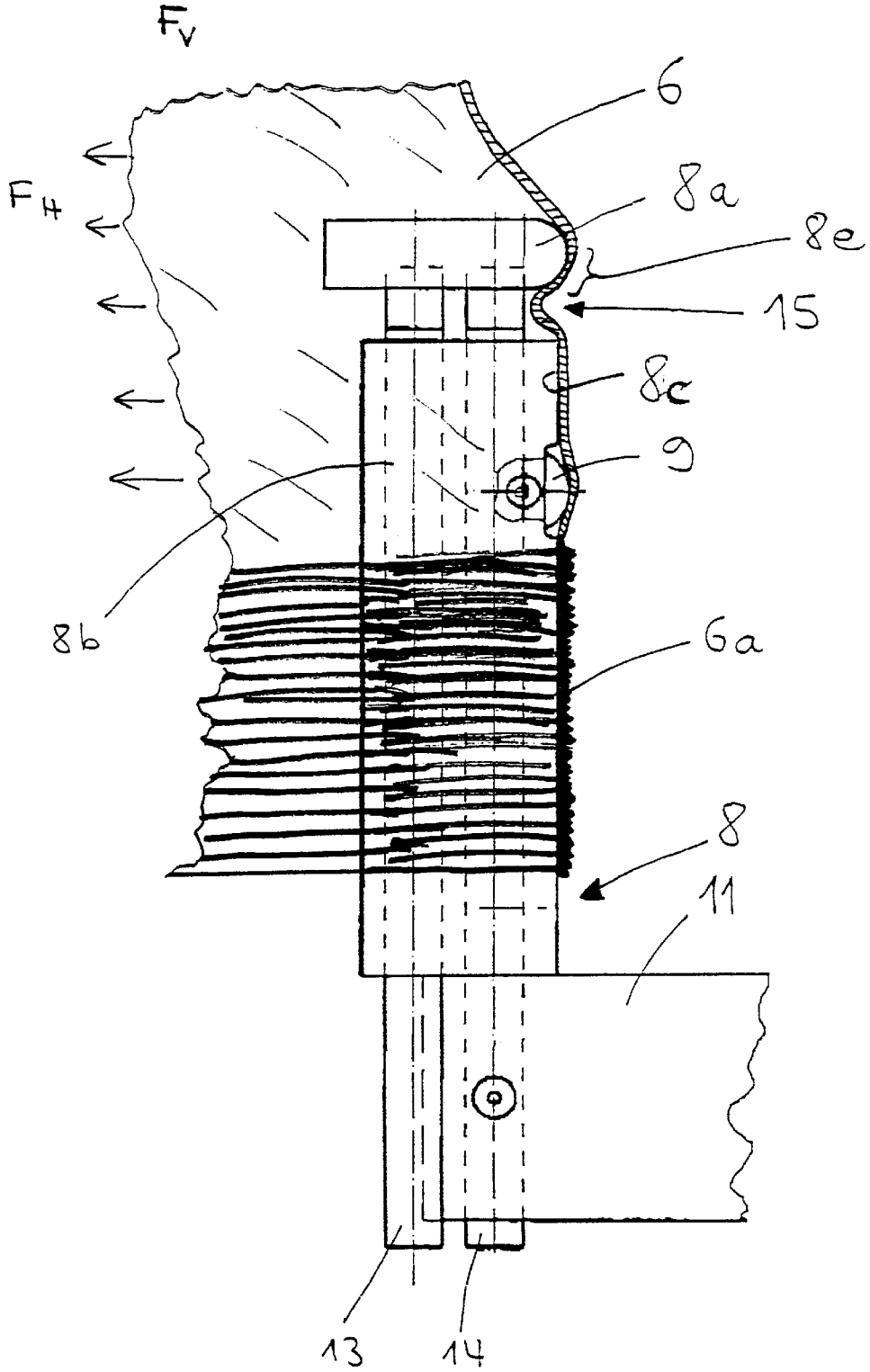
FIG. 5 shows an enlarged detailed view of a gripping means during the pulling-over phase.

This phase of pulling-over under vertical stretching is shown in FIG. 2 and the relating enlarged detailed view in FIG. 5. During pulling-over said foil hood 6 is continually pulled off in vertical direction from the resting reefed supply 6*a*. It passes the freely rotating roll 9 serving as counter-roll for said reef roll 10 when the foil arrives. From the main slide surface 8*a* of the bow-like frame section 8 said foil is pulled over the gap 15 representing a recess.

A deviating embodiment (not shown here) of the recess, e.g. as an only local basin rounded on all sides is possible. In case of only local extension of the recess it therein is particularly advantageous if said recess extends over the outer corner, i.e. the point of intersection of the two legs of the gripping means.

As said foil in the area of said gap 15 no longer is supported by bow-shaped frame section, it contracts due to its pretension during the passage over the gap, i.e. it moves into said gap guided by a guide 12. Due to the fact that said foil caused by its interior friction cannot contract completely abruptly, it depends one the measurements L and T of said gap (measurement see FIG. 9) with which intensity the foil moves into said gap.

Due to the penetration of said foil into said gap 15 encircling of the bow-like frame section 8 is enlarged. Said foil in increased manner bears on the region 8*e* of said bow-like frame section 8*a*, not facing the slide side of said foil. The foil contacting the bow-like frame section in this region can only be removed from said bow-shaped frame section 8*a* by further extending it, seen in direction of circumference. This causes an essential increase in the frictional forces effective during pulling off, as now said foil no longer is pulled off only by the horizontal forces indicated as $F_H$ at the foil cutting line, of said foil (resulting from the foil tension in horizontal direction) against said bow-like frame section 8*a*. Also the vertical foil forces indicated as $F_V$ at the vertical cutting line of said foil now very essentially contribute to pulling said foil against the area not facing the slide side of said foil, of said bow-like frame section 8*a*. A self-energizing effect occurs. The forces tending to pulling said foil off from said bow-like frame section 8 simultaneously increase the frictional forces counteracting to such pulling off.

Figure 9:
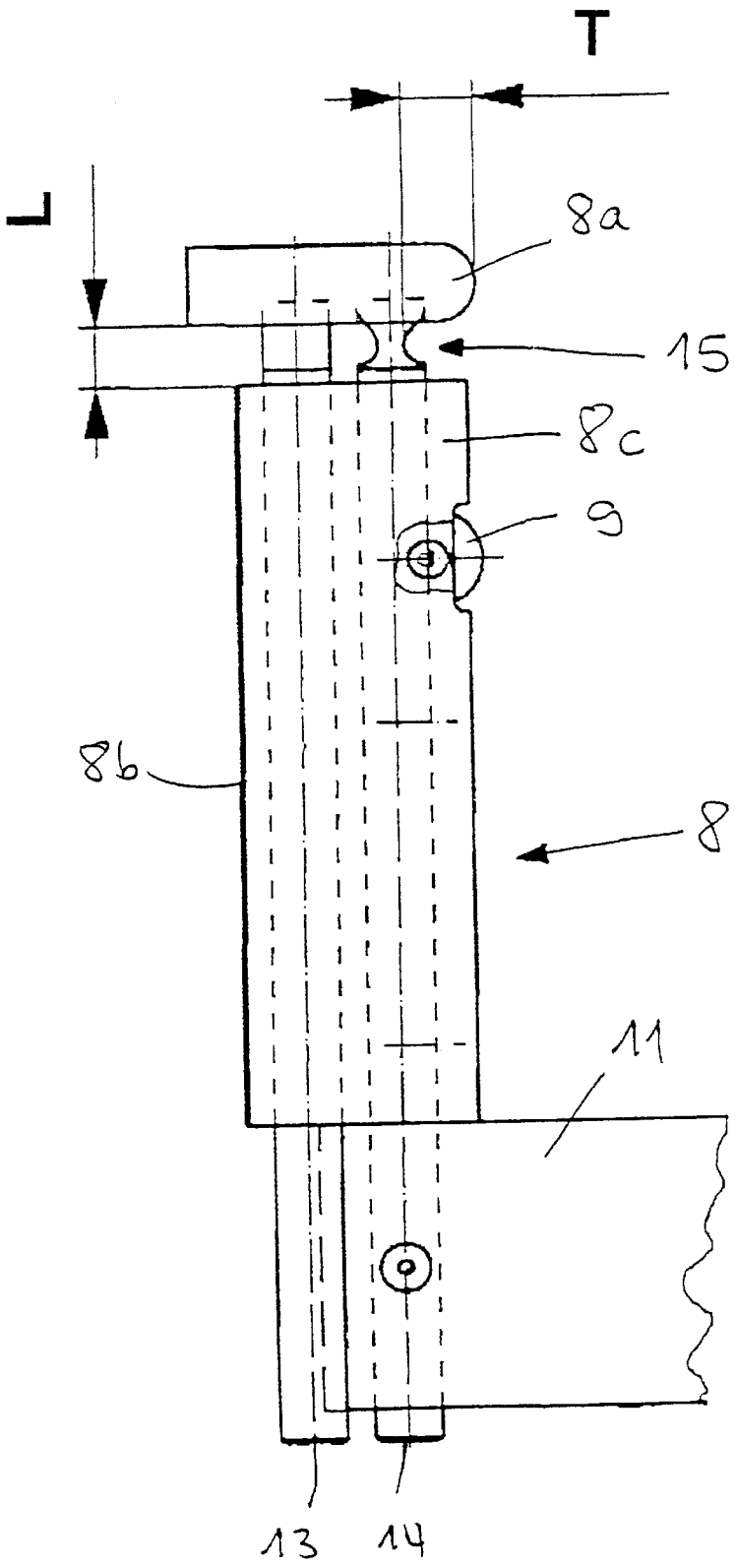
FIG. 9 shows a side view of another embodiment of the gripping means.

It can be seen that the vertical stretch i.e. the slide friction force occurring during pulling-off, can in a wide range being influenced in that the length on which said foil 6 encloses said bow-like frame section 8*a* is adapted T to the respectively existing requirements by varying the gap measurements L and/or (FIG. 9).

Figure 6:
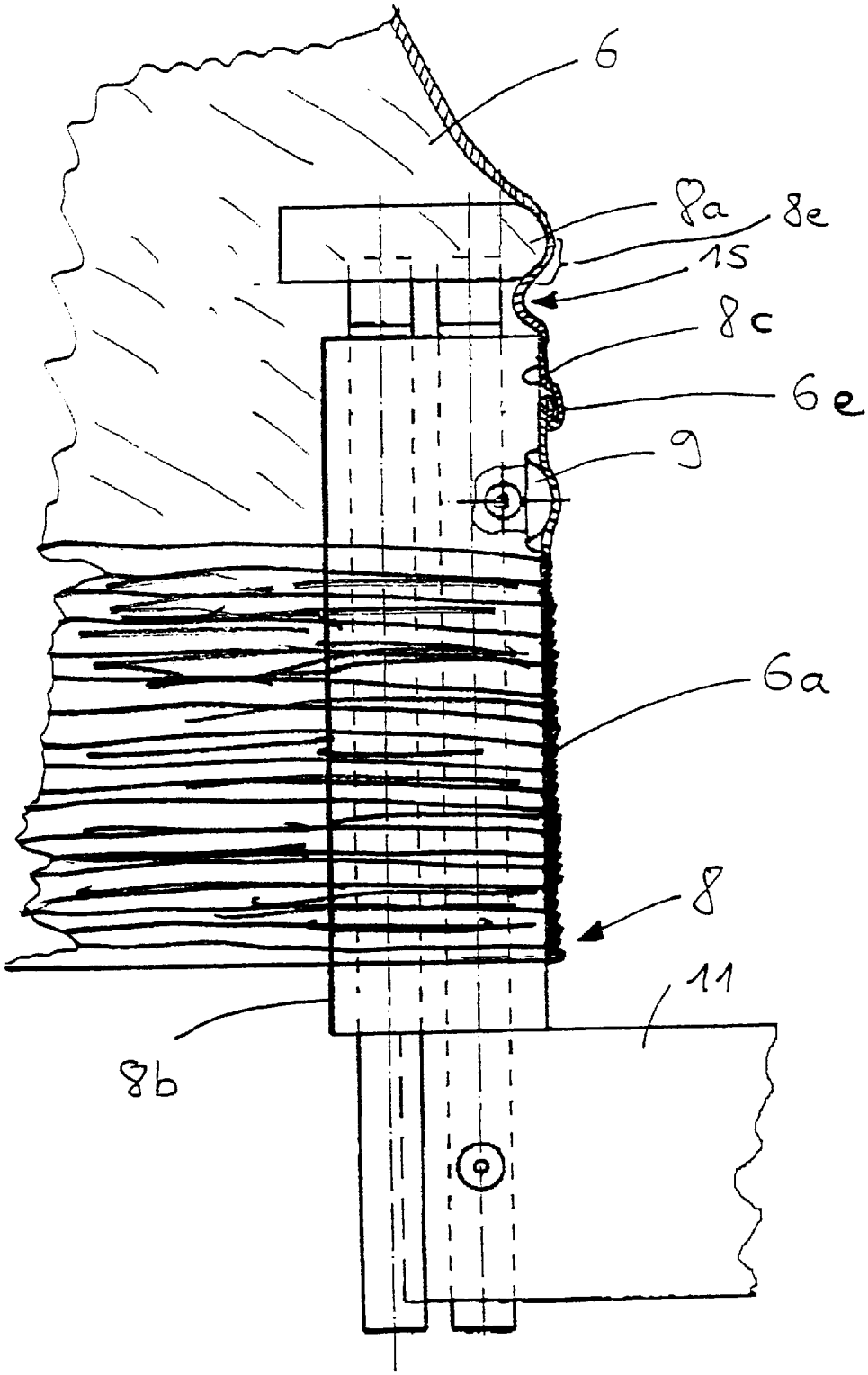
FIG. 6 shows an enlarged detailed view of a gripping means during the pulling-over phase with occurrence of fold wrapping.

FIG. 6 shows the conditions when during pulling-over of said hood a fold 6*a* is pulled down from the reefed supply 6*a*. The fold slides along the slide surface 8*c* of said bow support 8*b*. The folded foil section are closely pressed onto one another by the strong horizontal pretension of said foil. Between the foil sections lying one on the other in folds adhesive friction will occur. If said adhesive friction under unfavorable conditions is larger than the slide friction between said foil and said slide surface of said gripping means, the fold can no longer unfold as long as it slides over said gripping means under tension. This is undesired, since in particular when a fold reaches the region of said bow-like frame section said foil is subjected to inadmissible loads.

Said gap 15 prevents this. As soon as said fold 6 slides into the area of said 15, said fold for a short time is released from the horizontal forces. The foil sections lying one on top of the other in folds no longer are pressed against one another. The fold can unfold, said foil in its entity can align itself.

Figure 7:
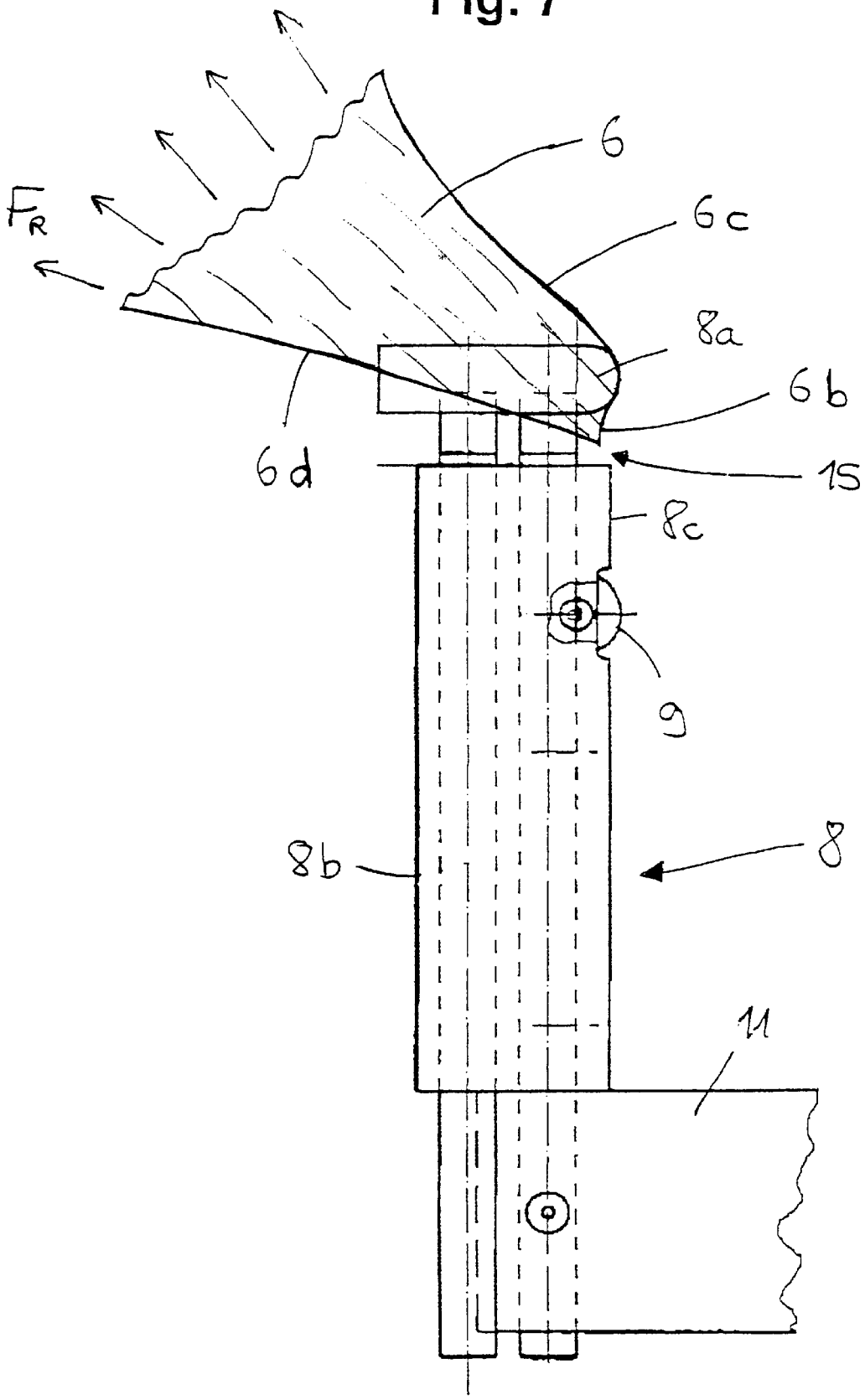
FIG. 7 shows an enlarged detailed view of a gripping means in the end of the pulling-over phase.

FIG. 7 shows the conditions directly at completion of pulling-over of said hood. The vertical movement of said gripping means 8 is completed. The foil has been completely removed said slide surface 8*c* of said bow support 8*d*. The foil end just has moved into said gap 15.

FIG. 7 represents an instantaneous view to such extent that it shows an outer end 6*b* of said foil hood, presently freely protuding into sad gap. Said end, however, will immediately contact the ground of said gap 15 or preferably to the region of said bow-like frame section 8*a*, not facing the slide side of said foil in particular in dependency on the inner friction of said foil due to the foil forces $F_R$ resulting in the cutting surface of said foil (from said horizontal foil forces $F_H$ and said vertical foil forces $F_V$, see FIG. 5).

Figure 8:
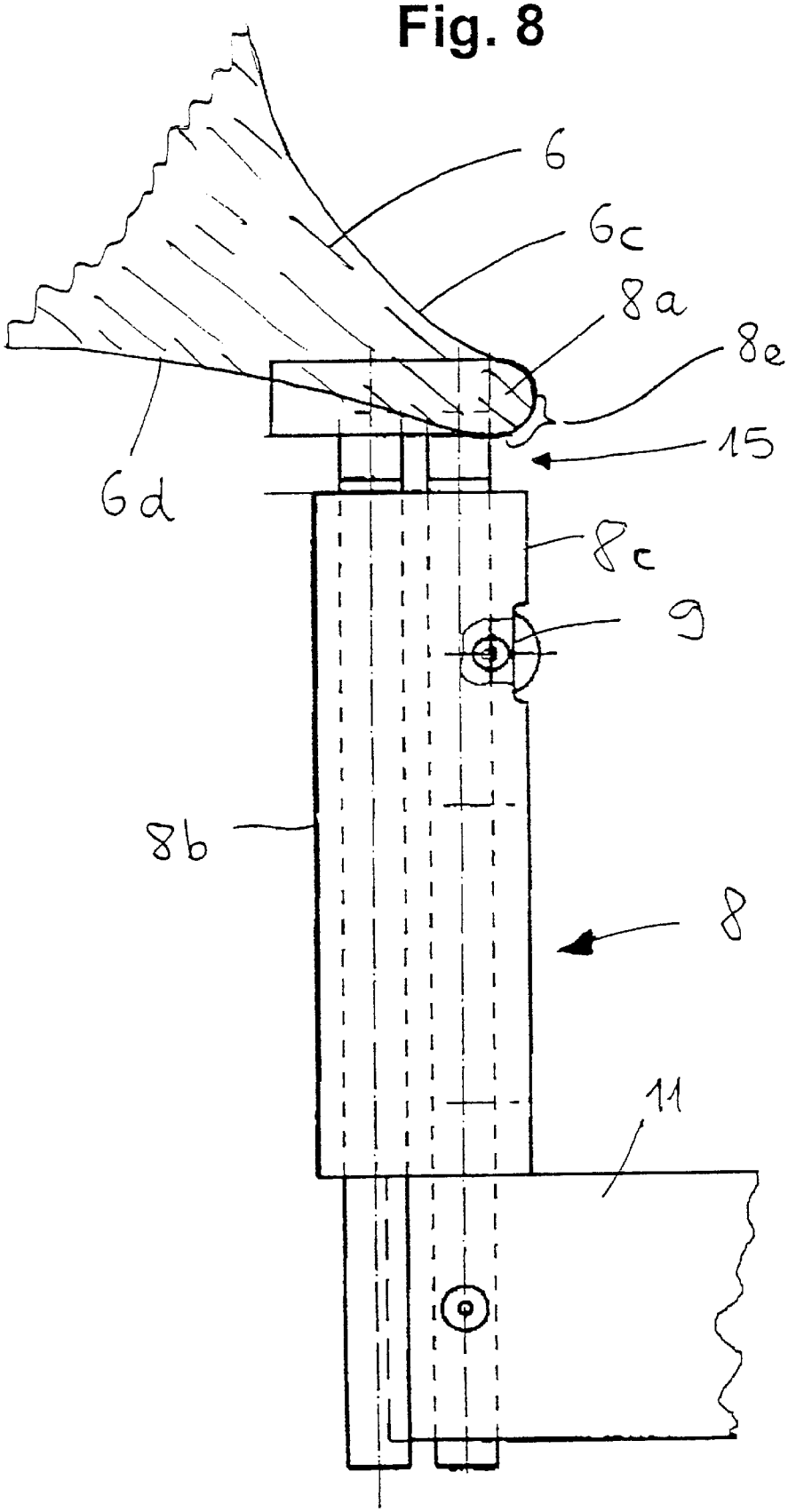
FIG. 8 shows another enlarged detailed view of a gripping means in the end of the pulling-over phase.

Thus, the situation shown in FIG. 8 occurs. Said bow-like frame section 8*a* reaches behind said foil opening. On each of the four lower end points of said foil hood a kind of "pocket" is drawn into said foil. Said "pocket" loops around said bow-like frame section 8*a*. The looping angle (i.e. the angle with which said foil loops around the area of said bow-like frame section 8*a*, not facing said slide side of said foil as compared to horizontal) preferable is larger than 30 degrees. The opening 6*d* of said foil hood has a smaller circumference than the areas of said foil hood, following in direction of the hood inside, as these are extended by said bow-like frame section 8*a*.

Thus, said foil hood can during creation of the under-stretch be safely held between foil and bow-like frame section 8*a* by the adhesive friction alone. For letting said foil hood slide from said holding sections 8*b*, said foil hood had to be further extended in circumferential direction in the area of its opening 6*d*. The forces required therefore, however, are no longer available due to the far-reaching enveloping of said holding section 8*b* and the correspondingly high frictional forces. The self-energizing effect described in connection with FIGS. 2 and 5 are now acts in favor of adhesive friction. In case of suitable dimensioning of gap self-locking will occur, i.e. the forces tending to pulling down said foil from said bow-like frame sections 8*a*, simultaneously always pull said foil in such extent to the areas of said bow-like frame sections 8*a*, not facing the slide side of said foil that the adhesive friction is increased insuperably.

Additional holding measurements like pressing of the foil etc. are possible but are not required in principle.

When dimensioning said gap and the length of the foil end protruding into said gap during creation of the understretch, the following effect can be made use of if required. As long said foil during the pulling-over phase of said hood bridges said gap, it does not move into said gap completely in case of corresponding dimensioning of said gap. Thereby it can be caused that said foil envelopes said bow-like frame section 8*a* only in such extent that the adhesive friction is increased cut no self-locking will occur. The foil end can move into said gap deeper and thus contacts said bow-like frame section 8*a* in higher degree. Thus, the friction can be further increased in the pulling-over end phase. Self-locking of said foil can possibly be reached during the pulling-over end phase.

Figure 4:
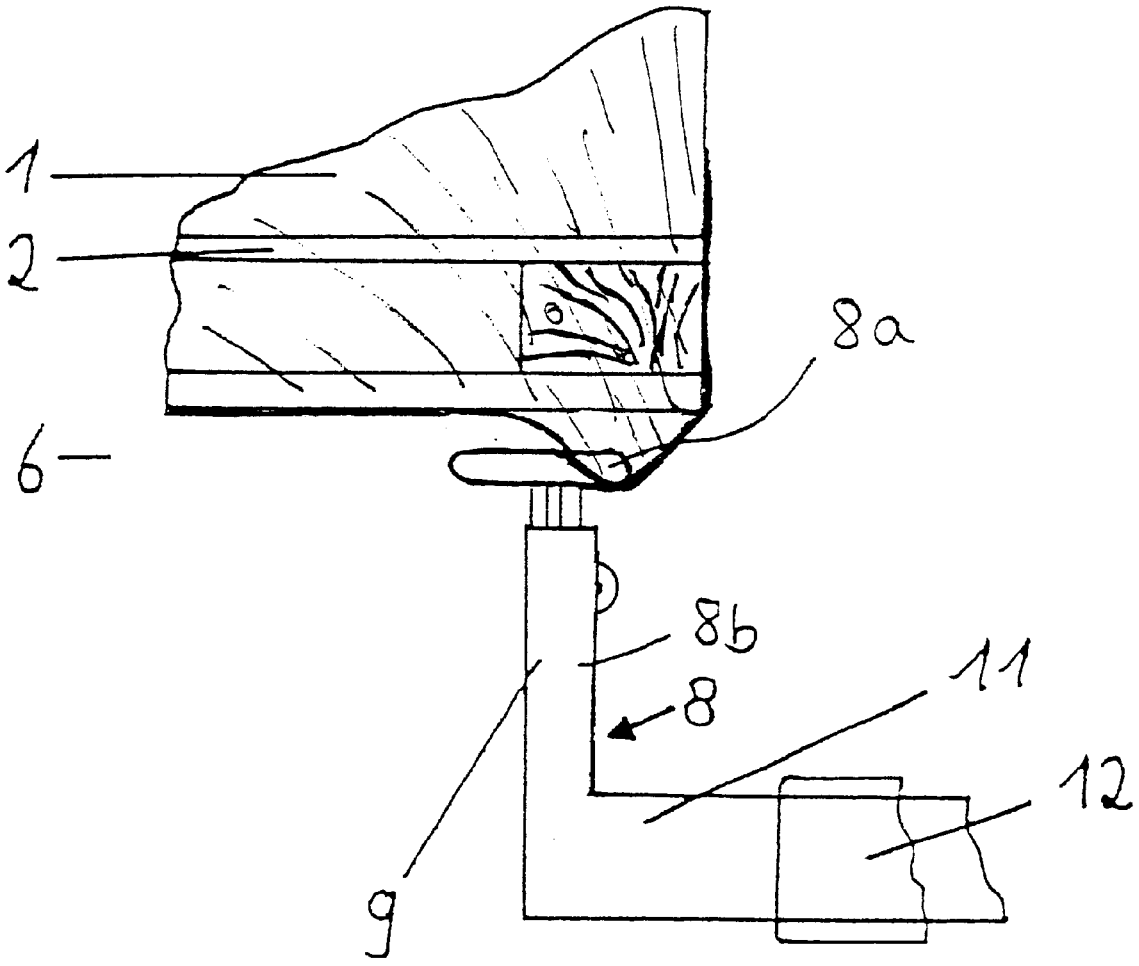
FIG. 4 shows a gripping means after creation of the undershrink.

FIG. 4 shows the conditions during completion of the understretch. Said foil contacted the lateral edge of the pallet in frictional lock. The tension of said foil in vertical direction thereby has gone almost completely. Said bow-like frame section 8*a* can therefore be easily be released from the engagement with said foil by a further moving-in of said gripping means 8.

FIG. 9 shows a bow-like frame section 8 in which an alternative embodiment of said gap is realized. The rounding in the base of said gap can in advantageous manner partly support said foil when crossing said gap. Furthermore, said rounding can during holding shown in FIG. 8, of said foil have a positive effect in that said foil also in this phase with its outermost end extends until into the area of said rounding.

The dimension L shown in FIG. 9 can be changed in simple manner in pulling out said bow-like frame section 8*a* fixed to the guide rods 13 and 14, in vertical direction more or less wide out from said bow supports 8*d*. When said rods 13 and 14 are running in corresponding guides, it only is necessary for this purpose to eliminate the clamping (not shown in FIG. 9) between said rods 13 and 14 and their guides. In required, the dimension L can also be changed during pulling-over provided that a possibility is provided for displacing said rods 13 and 14 by engine drive.

There are various possibilities for adjusting the dimension T shown in FIG. 9. As example merely the possibility is shown of supporting said rod 15 in eccentrically turnable manner. Such support would at the same time also admit a simple motive adjustability of the dimension T. Apart from that it also is possible to work using sleeves (if required, profiled ones) which are put over said rod 15 or over said rods 13 and 14 in the area of said gap 15.

Figure 10:
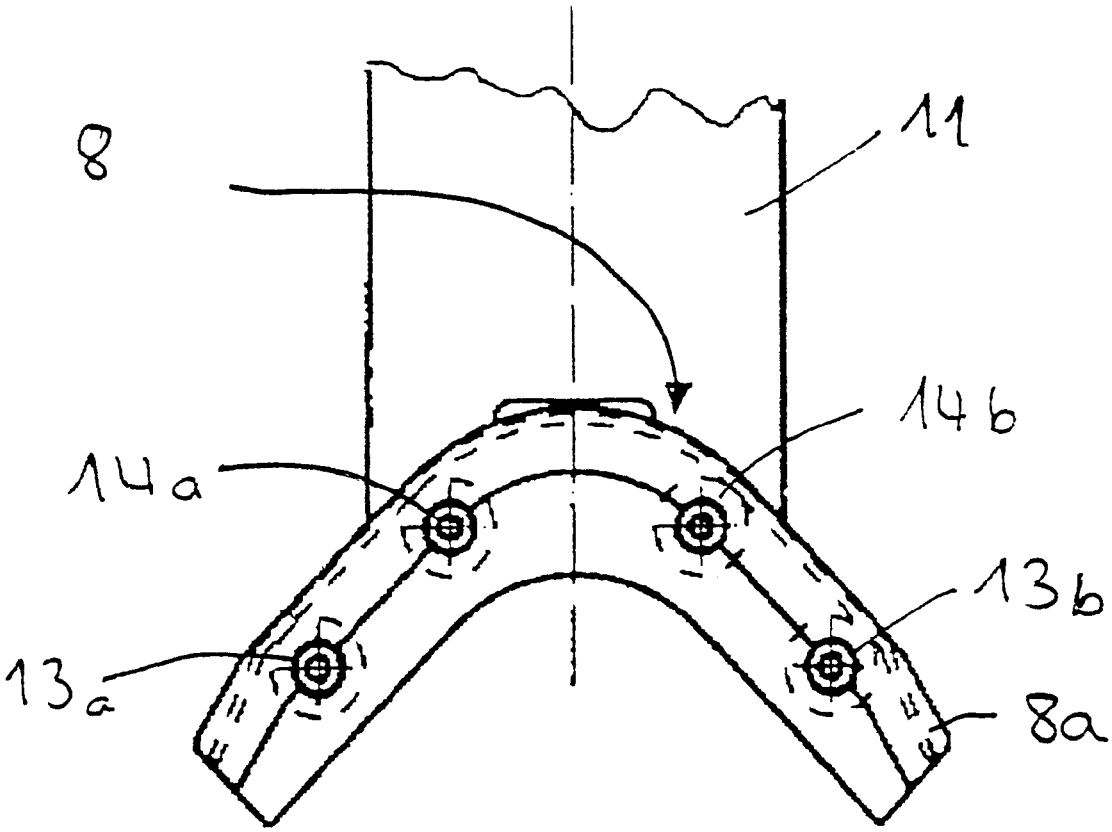
FIG. 10 is a top view onto a bow-shaped holding section.

FIG. 10 shows a view onto a bow-like frame section 8*a*, seen from top. Said rods 13*a* and 14*a* have a profile in the area of said gap 15 indicated in dashed form and thus permit in locally aimed manner to guide and/or support, respectively, said foil located in the area of said gap 15. Said rods correspond to said rod 15 shown in FIG. 9. Said rods 13*b* and 14*b* represent an alternative embodiment. They are continuously circularly cylindrically and do not offer any particularly defined support or guide.

What is claimed is:

1. A method for packaging objects of a stack of goods (1) on a pallet in particular, with a hose-shaped stretch foil which is reefed on several gripping means (8) with bow-shaped frame sections (8*a*) and frame supports (8*b*) of a lifting frame movable in vertical direction and tented by means of said gripping means in such manner that the tented opening of said foil hood (6) is larger than the horizontal projection of the good to be packed and wherein said foil hood (6) is pulled over said object with a certain extension transverse to the plane of the tented opening of said foil hood, characterized in that said foil prior to leaving the respective gripping means (8) is guided over at least one recess (15) in the slide surface of said gripping means in order to increase the pulling-off resistance such that it is deflected with respect to its pulling-off direction.

2. A method as defined in claim 1, characterized in that said foil (6) is guided over a gap (15) arranged between said bow-shaped frame sections (8*a*) and said frame support (8*b*).

3. A method as defined in claim 2, characterized in that said gap (15) during pulling-off of said foil is changed in its depth (T) and/or its lengths (L).

4. A method as defined in claim 3, characterized in that said foil (6) is guided such that the lower rim of said foil hood in the pulling-over phase moves into said gap (15) and contracts such that the foil end is at least temporarily held during the movement of said gripping means (8) to the inside with respect to the pulling-over contour for creation of an understretch.

5. A method as defined in claim 2, characterized in that said foil (6) is guided such that the lower rim of said foil hood in the pulling-over phase moves into said gap (15) and contracts such that the foil end is at least temporarily held during the movement of said gripping means (8) to the inside with respect to pulling-over contour for creation of an understretch.

6. A method as defined in claim 1, characterized in that said gap (15) during pulling-off of said foil is changed in its depth (T).

7. A method as defined in claim 6, characterized in that said foil (6) is guided such that the lower rim of said foil hood in the pulling-over phase moves into said gap (15) and contracts such that the foil end is at least temporarily held during the movement of said gripping means (8) to the inside with respect to the pulling-over contour for creation of an understretch.

8. A method as defined in claim 1, characterized in that said foil (6) is guided such that the lower rim of said foil hood in the pulling-over phase moves into said gap (15) and contracts such that the foil end is at least temporarily held during the movement of said gripping means (8) to the inside with respect to the pulling-over contour for creation of an understretch.

9. A method as defined in claim 1, characterized in that said foil (6) is guided over said gap (15) such that it only partly is in contact with the surfaces bordering said gap.

10. The method as defined in claim 1, characterized in that said stretch foil is hood-shaped.

11. The method as defined in claim 1, characterized in that said gap (15) during pulling-off of said foil is changed in its length (L).

12. An apparatus for packaging objects of a stack of goods (1) on a pallet in particular, with a hose-shaped stretch foil (6) and with gripping means (8) arranged on a lifting frame and formed by bow-shaped frame sections (8*a*) comprising essentially rounded foil contact surfaces, with bow supports (8*b*) and by reef rolls (10) which can be brought into contact therewith, for reefing and transverse stretching of said foil hood (6), said gripping means together with said lifting frame being movable in vertical direction along the objects to be packed, characterized in that said slide surface of said gripping means (8) at least one recess (15) is provided for, by which said foil can be deflected with respect to its pulling-off direction in order to enlarge the pulling-off resistance.

13. An apparatus as defined in claim 12, characterized in that the at least one recess (15) of said slide surface is located as close as possible to the end of said gripping means, from which said foil leaves said gripping means.

14. An apparatus as defined in claim 13, characterized in that the at least one recess (15) of said slide surface is located in said bow-shaped frame sections **(8*a*)**.

15. An apparatus as defined in claim 13, characterized in that the at least one recess (15) of said slide surface is located in said bow support **(8*b*)**.

16. An apparatus as defined in claim 12, characterized in that the at least one recess (15) of said slide surface is located in said bow-shaped frame sections **(8*a*)**.

17. An apparatus as defined in claim 12, characterized in that said slide surface merges into said recess (15) almost in a leap seen in direction of leaving direction of said foil (6).

18. An apparatus as defined in claim 12, characterized in that the length (L) and said recess (15) in leaving direction amounts to 10 mm at least.

19. An apparatus as defined in claim 12, characterized in that said recess (15) of said slide surface is formed by a gap.

20. An apparatus as defined in claim 1, characterized in that said gap (15) is located between said bow-shaped frame section **(8*a*) and said bow support (8*b*)**.

21. An apparatus as defined in claim 12, characterized in that said gap (15) is variable in its depth (T).

22. An apparatus as defined in claim 12, characterized in that said gap (15) is variable in its depth (T) during pulling-off of said foil (6).

23. An apparatus as defined in claim 12, characterized in that said gap (15) extends on each bow-shaped frame sections **(8*a*)** over the entire external circumference thereof.

24. An apparatus as defined in claims 12, characterized in that said bow-shaped frame sections **(8*a*)** in particular are provided with a friction-increasing coating or are manufactured from a material having a particularly high friction coefficient in contact with synthetic foil materials.

25. An apparatus as defined in claim 12, characterized in that said gap (15) along its extension in pulling-off direction of least locally comprises guide surfaces for said foil (6).

26. The apparatus as defined in claim 12, characterized in that said stretch foil is hood-shaped.

27. The apparatus as defined in claim 12, characterized in that the at least one recess (15) of said slide surface is located in said bow support **(8*b*)**.

28. An apparatus as defined in claim 12, characterized in that said gap (15) is variable in its or/and its length (L).

29. An apparatus as defined in claim 12, characterized in that said gap (15) is variable in its length (L) during pulling-off of said foil (6).

* * * * *